US008042451B2

(12) United States Patent
Matsuzaki et al.

(10) Patent No.: US 8,042,451 B2
(45) Date of Patent: Oct. 25, 2011

(54) HYDRAULIC CONTROL APPARATUS

(75) Inventors: Takeharu Matsuzaki, Kariya (JP); Shigeto Nakajima, Nagano (JP)

(73) Assignees: Kabushiki Kaisha Toyota Jidoshokki, Aichi-ken (JP); Nishina Industrial Co., Ltd., Nagano-ken (JP)

( * ) Notice: Subject to any disclaimer, the term of this patent is extended or adjusted under 35 U.S.C. 154(b) by 755 days.

(21) Appl. No.: 11/667,054

(22) PCT Filed: Nov. 8, 2005

(86) PCT No.: PCT/JP2005/020776

§ 371 (c)(1),
(2), (4) Date: Jul. 31, 2008

(87) PCT Pub. No.: WO2006/049344

PCT Pub. Date: May 11, 2006

(65) Prior Publication Data

US 2008/0302098 A1 Dec. 11, 2008

(30) Foreign Application Priority Data

Nov. 8, 2004 (JP) ..... 2004-323231

(51) Int. Cl.
*B66F 9/22* (2006.01)
*F15B 11/00* (2006.01)

(52) U.S. Cl. ..... 91/447; 91/445

(58) Field of Classification Search ..... 91/444, 91/445, 447

See application file for complete search history.

(56) References Cited

U.S. PATENT DOCUMENTS

| | | | | |
|---|---|---|---|---|
| 4,088,151 | A | 5/1978 | Schurger | |
| 4,204,459 | A * | 5/1980 | Johnson | 91/445 |
| 5,048,395 | A | 9/1991 | Ohshima | |
| 6,371,006 | B1 * | 4/2002 | Goto et al. | 91/445 |

FOREIGN PATENT DOCUMENTS

| | | | |
|---|---|---|---|
| EP | 0 375 916 | | 7/1990 |
| EP | 0 491 155 | | 6/1992 |
| EP | 491155 | A1 * | 6/1992 |
| EP | 1344945 | A2 | 9/2003 |
| JP | 2002-327706 | | 11/2002 |

OTHER PUBLICATIONS

International Search Report for corresponding International PCT application No. PCT/JP2005/020776, dated Feb. 9, 2006.
Communication Pursuant to Article 94(3) EPC for application No. 05 803 468.7-1252, dated Dec. 7, 2010.

* cited by examiner

*Primary Examiner* — Thomas E Lazo
(74) *Attorney, Agent, or Firm* — Locke Lord Bissell & Liddell LLP

(57) ABSTRACT

A hydraulic control apparatus 1 includes a switch valve 11, an adjustment valve 12, and a valve control device 13. The adjustment valve 12 has a fluid chamber 15, a valve body 14, and a back pressure chamber 17. A restrictor is formed between the valve body 14 and a wall defining the fluid chamber 15 and connects the cylinder line 32 to the switch valve line 33. The opening degree of the restrictor changes in correspondence with movement of the valve body 14. When the switch valve 11 is located at a neutral position or a supply position, the valve control device 13 applies the fluid pressure in the cylinder line 32 to the back pressure chamber 17. When the switch valve 11 is located at a drainage position, the valve control device 13 applies a pilot pressure lower than the fluid pressure in the cylinder line 32 to the back pressure chamber 17.

11 Claims, 4 Drawing Sheets

HYDRAULIC CONTROL APPARATUS

FIELD OF THE INVENTION

The present invention relates to hydraulic control apparatuses having switch valves for controlling supply and drainage of fluid to single-acting cylinders.

BACKGROUND OF THE INVENTION

As a hydraulic control apparatus having a switch valve for controlling supply and drainage of fluid to and from a single-acting cylinder, a hydraulic control apparatus used in, for example, a forklift is known. The hydraulic control apparatus may be employed for actuating a lift cylinder of the forklift, which selectively raises and lowers a fork, as described in Japanese Laid-Open Patent Publication No. 2002-327706.

The hydraulic control apparatus of the publication includes an operation check valve and a flow regulator provided in a main passage. The main passage connects a lift control valve, which is operated by means of a lift lever, to the lift cylinder. The lift control valve has a spool that includes a variable restrictor and is switched among a raising position, a neutral position, and a lowering position. More specifically, when the spool is located at the neutral position or the raising position, the lift control valve seals a back pressure chamber of the operation check valve. The operation check valve is thus urged in a direction for blocking the main passage. Meanwhile, a pump operates to apply hydraulic pressure to a second pressure chamber of the flow regulator and a valve body of the flow regulator is maintained at a fully open position.

In contrast, when the spool is located at the lowering position, a tank operates to apply hydraulic pressure to the back pressure chamber of the operation check valve. The operation check valve thus opens the main passage using the hydraulic pressure generated by the lift cylinder. Meanwhile, the hydraulic pressure in the tank is supplied to the second pressure chamber of the flow regulator. This causes the valve body of the flow regulator to move in such a manner that the difference between the pressure in a portion upstream from the variable restrictor and the pressure in a downstream portion is maintained equal to or lower than a predetermined value. The flow rate of the hydraulic oil flowing from the lift cylinder is thus adjusted.

However, in the hydraulic control apparatus, the operation check valve and the flow regulator are formed separately. Besides, the hydraulic control apparatus includes a large number of components and thus has a relatively complicated configuration. Further, since the operation check valve and the flow regulator must be accommodated separately in two different spaces, the hydraulic control apparatus becomes relatively large.

SUMMARY OF THE INVENTION

Accordingly, it is an objective of the present invention to provide a simply configured and compact hydraulic control apparatus that functions as an operational check valve and a flow regulator that adjusts a drainage flow rate of fluid.

To achieve the foregoing and other objectives and in accordance with the purpose of the present invention, the invention provides a hydraulic control apparatus for a single-acting cylinder having a switch valve, a cylinder line, a switch valve, an adjustment valve, and a valve control device. The switch valve controls supply and drainage of a fluid with respect to the cylinder. The switch valve is switched among a supply position for supplying the fluid to the cylinder, a drainage position for draining the fluid from the cylinder, and a neutral position for preventing the supply and the drainage of the fluid with respect to the cylinder. The cylinder line is connected to the single-acting cylinder. The switch valve line is connected to the switch valve. The adjustment valve is arranged between the cylinder line and the switch valve line for selectively connecting and disconnecting the cylinder line and the switch valve line with respect to each other. The valve control device controls operation of the adjustment valve. The adjustment valve includes a fluid chamber, a valve body movably received in the fluid chamber, and a back pressure chamber into which a fluid pressure acting on the valve body is introduced. A restrictor is formed between the valve body and a wall defining the fluid chamber for connecting the cylinder line to the switch valve line. An opening degree of the restrictor is changed in correspondence with movement of the valve body. When the switch valve is located at the neutral position or the supply position, the valve control device applies a fluid pressure in the cylinder line to the back pressure chamber for urging the valve body in a direction for disconnecting the cylinder line from the switch valve line. When the switch valve is located at the drainage position, the valve control device applies a pilot pressure lower than the fluid pressure in the cylinder line to the back pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An embodiment of the present invention will now be described with reference to the attached drawings.

Figure 1:
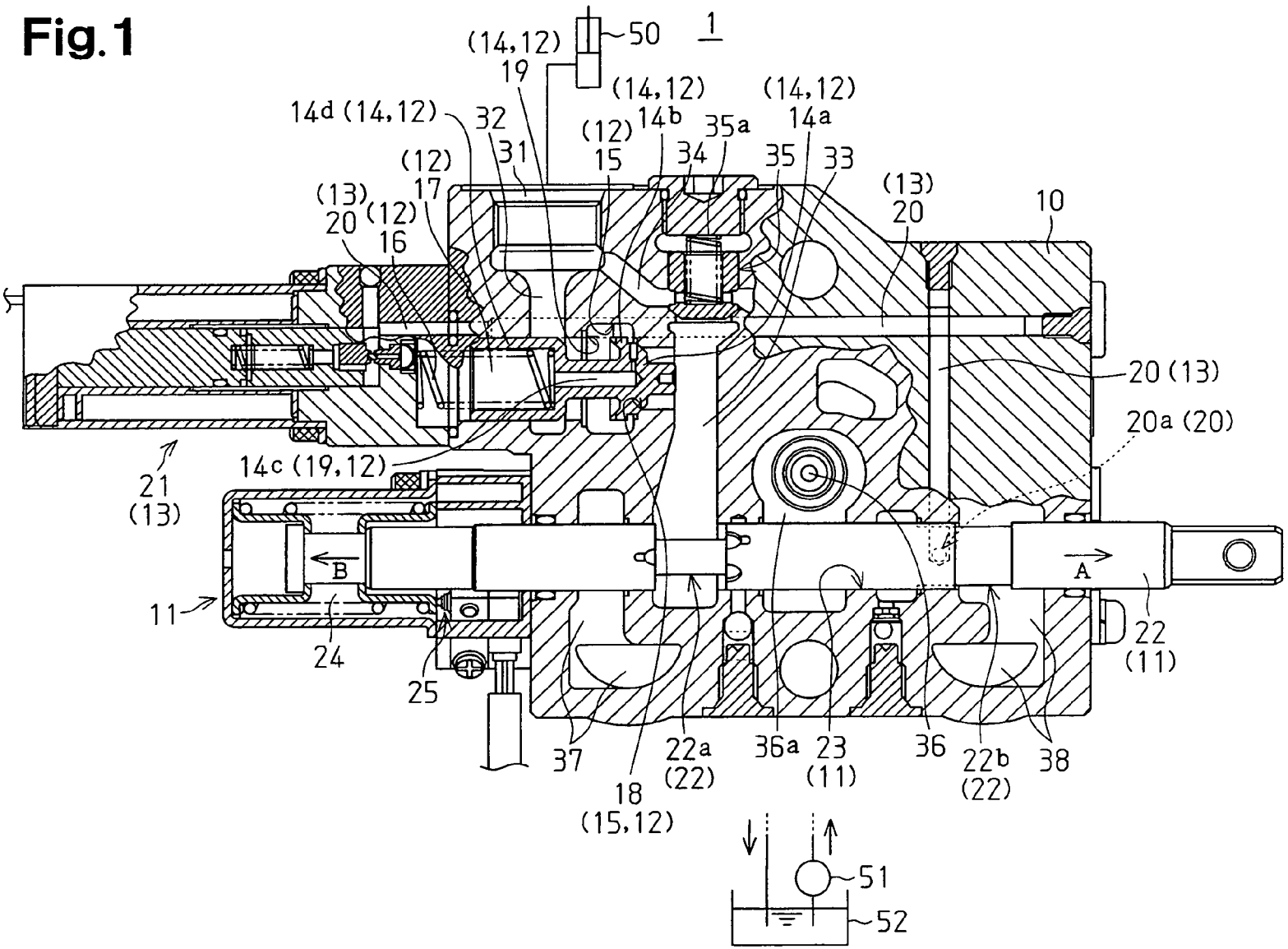
FIG. 1 is a cross-sectional view showing a hydraulic control apparatus according to an embodiment of the present invention.

FIG. 1 is a cross-sectional view showing a hydraulic control apparatus 1 according to the embodiment of the invention. The hydraulic control apparatus 1 is employed for actuating a lift cylinder 50 of a forklift, which selectively raises and lowers a fork. The lift cylinder 50 is formed by a single-acting cylinder. The forklift has a lift cylinder control circuit, or a hydraulic circuit in which the lift cylinder 50 is arranged. The hydraulic control apparatus 1 defines a part of the lift cylinder control circuit. The forklift further includes a hydraulic pump 51 and different hydraulic circuits (not shown) including a tilt cylinder control circuit and a power steering system hydraulic circuit. The hydraulic pump 51 supplies hydraulic oil (fluid) to different circuits including the lift cylinder control circuit. The hydraulic oil is then returned from the circuits to a tank 52, which is provided in the forklift, re-pressurized by the hydraulic pump 51, and then recirculated to the circuits.

As shown in FIG. 1, the hydraulic control apparatus 1 includes a valve housing 10, a switch valve 11, an adjustment valve 12, and a valve control device 13. Different ports and lines are defined in the valve housing 10 and the switch valve 11, the adjustment valve 12, and the valve control device 13 are incorporated in the valve housing 10.

A cylinder port 31 is defined in the valve housing 10 and connected to the lift cylinder 50, thus defining a supply-drainage port for selectively supplying the hydraulic oil to the lift cylinder 50 and draining the hydraulic oil from the lift cylinder 50. The valve housing 10 includes a supply line 36, a first tank line 37, and a second tank line 38. The supply line 36 communicates with the hydraulic pump 51 and is supplied with the hydraulic oil from the hydraulic pump 51. The first and second tank lines 37, 38 communicate with the tank 52. The valve housing 10 further includes a cylinder line 32, a switch valve line 33, and a connection passage 34. The cylinder line 32 is defined continuously from the cylinder port 31 and communicates with the lift cylinder 50 through the cylinder port 31. The switch valve line 33 can be connected to the cylinder line 32 through the adjustment valve 12 and is connected to the switch valve 11. The connection passage 34 is defined in such a manner as to permit communication between the cylinder line 32 and the switch valve line 33. The connection passage 34 is defined separately from a hydraulic oil path (a first line) including the adjustment valve 12 and as a second line connecting the cylinder line 32 to the switch valve line 33. A check valve 35 is provided between the connection passage 34 and the switch valve line 33.

The switch valve 11 controls supply and drainage of the hydraulic oil with respect to the lift cylinder 50. The switch valve 11 is formed as a spool valve having a spool 22, a spool bore 23, and a spring mechanism 24. The spool 22 is arranged in the spool bore 23 in an axially movable manner. The spring mechanism 24 maintains the spool 22 at a neutral position. The spool 22 is caused to move axially through manipulation of a non-illustrated lift lever, thus switching the switch valve 11 (more specifically, the spool 22) among a supply position, the neutral position, and a drainage position.

In FIG. 1, the switch valve 11 is held at the neutral position at which the switch valve 11 does not permit either supply or drainage of the hydraulic oil with respect to the lift cylinder 50. If the spool 22 moves from the neutral position in a direction indicated by arrow A of FIG. 1, the switch valve 11 is switched to the supply position. In this state, as will be described later, the hydraulic pump 51 supplies the hydraulic oil to the lift cylinder 50 (see FIG. 2). Contrastingly, if the spool 22 moves from the neutral position of FIG. 1 in a direction indicated by arrow B of the drawing, the switch valve 11 is switched to the drainage position. In this state, the hydraulic oil is drained from the lift cylinder 50 to the tank 52 (see FIG. 3). The spool 22 includes a first land portion 22*a* having a relatively small diameter and a second land portion 22*b*, which are formed in two axial portions of the spool 22.

As shown in FIG. 1, the adjustment valve 12 has a valve body 14, a fluid chamber 15, a spring 16, and a back pressure chamber 17. The adjustment valve 12 is arranged between the cylinder line 32 and the switch valve line 33. The adjustment valve 12 operates in such a manner that the cylinder line 32 and the switch valve line 33 are selectively connected to or disconnected from each other.

The valve body 14 is axially movable in an area defined between the cylinder line 32 and the switch valve line 33, or in the first line. The valve body 14 has a valve portion 14*a*, an extended portion 14*b*, a pressure introduction line 14*c*, and a plunger portion 14*d*. The valve portion 14*a* corresponds to a distal portion of the valve body 14 and can be held in contact with a valve seat 18 formed by a portion of a wall of the fluid chamber 15. The extended portion 14*b* is formed around the valve portion 14*a* at a position opposed to the side of the valve portion 14*a* that contacts the valve seat 18. The pressure introduction line 14*c* is defined by a through hole extending through the valve body 14. The pressure introduction line 14*c* communicates with the fluid chamber 15 and the back pressure chamber 17 and may connect the cylinder line 32 to the back pressure chamber 17. The plunger portion 14*d* is slidably supported with respect to the valve housing 10. The plunger portion 14*d* includes a hollow portion, which defines a portion of the back pressure chamber 17.

Figure 3:
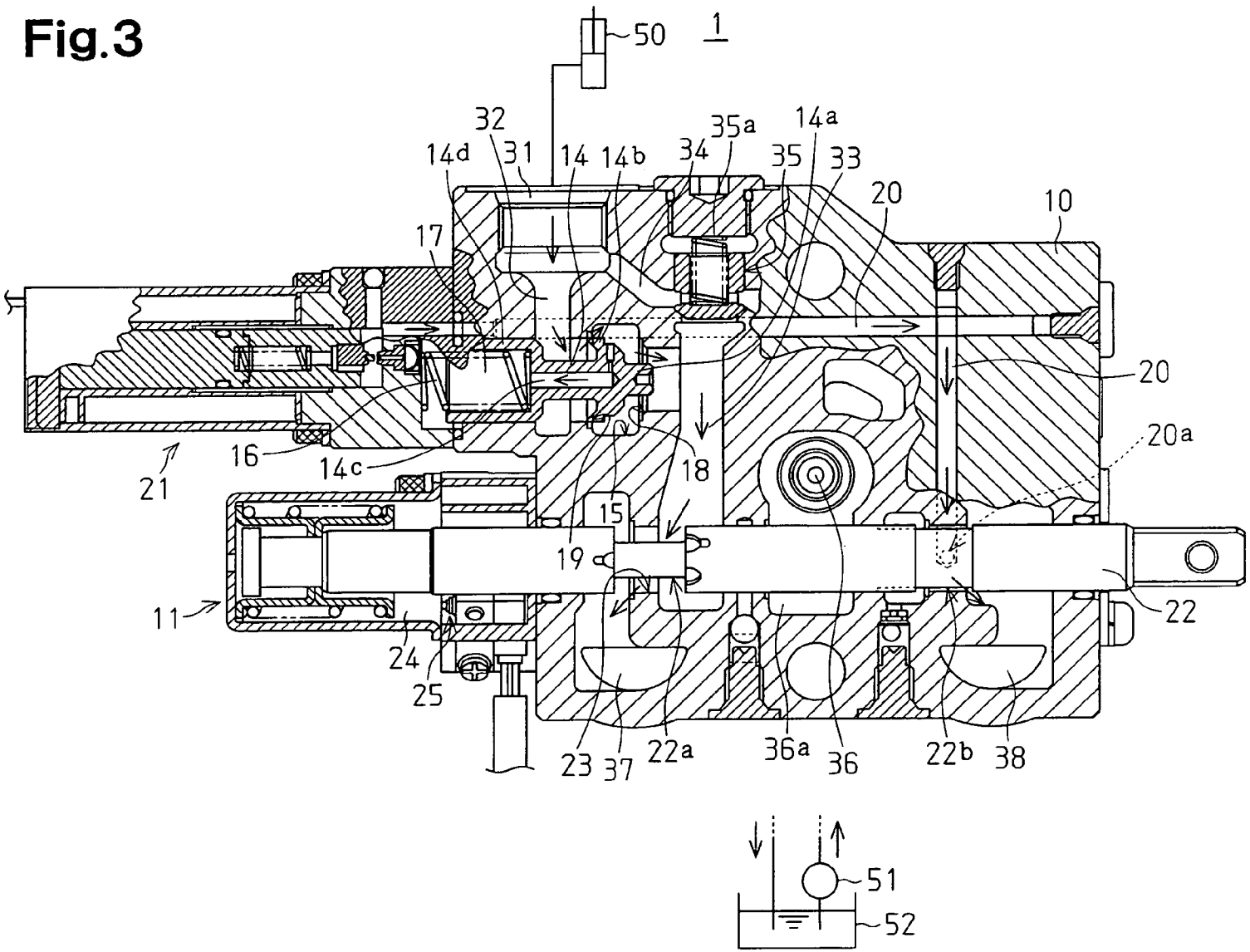
FIG. 3 is a cross-sectional view explaining the operation of the apparatus of FIG. 1.

The fluid chamber 15 defines an oil chamber, or an area in which the valve portion 14*a* is movable. The fluid chamber 15 includes an opening (a second opening) 18 connected to the switch valve line 33. A wall section of the fluid chamber 15 defining the opening 18 corresponds to the valve seat 18. When the valve body 14 is held in contact with the valve seat 18, the cylinder line 32 and the switch valve line 33 are disconnected from each other. Further, the fluid chamber 15 includes an opening (a first opening) 19 connected to the cylinder line 32. The opening 19 defines a restrictor for changing the communication area (the opening degree) of a passage between the cylinder line 32 and the switch valve line 33 in an area around the valve body 14 passed through the opening 19. That is, as shown in FIG. 3, when the valve body 14 is spaced from the valve seat 18 and thus holds the adjustment valve 12 in an open state, the restrictor is defined in the gap between the extended portion 14*b* of the valve body 14 and the wall section defining the opening 19 for changing the communication area of the passage between the cylinder line 32 and the switch valve line 33 in correspondence with movement of the valve body 14 (the extended portion 14*b*).

The spring 16, which serves as an urging member, is received in the back pressure chamber 17 and urges the valve body 14 toward the valve seat 18. The back pressure chamber 17 is defined by the hollow portion of the plunger portion 14*d* and the space in the valve housing 10 defined continuously from the hollow portion. As has been described, the back pressure chamber 17 can be connected to the cylinder line 32 through the pressure introduction line 14*c* of the valve body 14. The pressure of the hydraulic oil (the hydraulic pressure) in the back pressure chamber 17 is controlled by the valve control device 13.

The valve body 14 receives the urging force (a first urging force) generated by the spring 16 and the hydraulic pressure in the back pressure chamber 17 and the urging force (a second urging force) generated by the hydraulic pressure applied to the valve portion 14*a* and the extended portion 14*b* (or, in other words, the hydraulic pressure in the switch valve line 33). The adjustment valve 12 operates in correspondence with the first and second urging forces that act in opposing directions with respect to the valve body 14. If the first urging force is greater than the second urging force, the valve body 14 is maintained in contact with the valve seat 18, and the cylinder line 32 is disconnected from the switch valve line 33. In contrast, if the second urging force is greater than the first urging force, the valve body 14 is separated from the valve seat 18 (that is, the adjustment valve 12 becomes open). The valve body 14 is thus maintained at a position determined by equilibrium between the first urging force and the second urging force. Further, if, in this state, the hydraulic pressure in the switch valve line 33 rises, the second urging force acting on the valve body 14 increases. This further separates the valve body 14 from the valve seat 18, decreasing the opening size of the restrictor defined by the extended portion 14*b* at the position corresponding to the opening 19.

The valve control device 13 controls operation of the adjustment valve 12 and, as shown in FIG. 1, includes a pilot line 20 and an electromagnetic switch valve 21.

The pilot line 20 is defined in the valve housing 10 as a passage that connects the back pressure chamber 17 of the adjustment valve 12 to the tank 52 in correspondence with switching of the electromagnetic switch valve 21. The pilot line 20 defines a pilot pressure generating portion that generates pilot pressure lower than the hydraulic pressure in the cylinder line 32 and applies the hydraulic pressure to the back pressure chamber 17. The pilot line 20 has an opening 20*a* communicating with the spool bore 23 of the switch valve 11. If the spool 22 is moved in the direction indicated by arrow B of FIG. 1, the switch valve 11 is switched to the drainage position of FIG. 3. In this state, a second land portion 22*b* of the spool 22 corresponds to the opening 20*a* and thus the pilot line 20 is connected to a second tank line 38 through the spool bore 23.

In the opening 20*a* of the pilot line 20, only the portion corresponding to the second land portion 22*b* functions as a portion that is permitted to communicate with the second tank line 38. In other words, as the spool 22 moves in the direction indicated by arrow B of FIG. 1, the area of the portion of the opening 20*a* corresponding to the second land portion 22*b* gradually increases. The communication area (the opening degree) of the passage between the pilot line 20 and the second tank line 38 thus gradually increases, correspondingly.

The electromagnetic switch valve 21 is formed by an electromagnetic valve that is switched for selectively connecting and disconnecting the back pressure chamber 17 and the pilot line 20 with respect to each other. The electromagnetic switch valve 21 is excited or de-excited by a non-illustrated controller that detects the operational state of a limit switch 25 incorporated in the valve housing 10. When the switch valve 11 is held at the neutral position or the supply position, the electromagnetic switch valve 21 disconnects the back pressure chamber 17 from the pilot line 20 (see FIGS. 1 and 2). Contrastingly, if the switch valve 11 is held at the drainage position, the electromagnetic switch valve 21 connects the back pressure chamber 17 to the pilot line 20 (see FIG. 3). When the back pressure chamber 17 is disconnected from the pilot line 20, the hydraulic pressure in the cylinder line 32 is applied to the back pressure chamber 17 through the pressure introduction line 14*c* of the valve body 14. In contrast, when the back pressure chamber 17 is connected to the pilot line 20, the hydraulic pressure in the second tank line 38, which is the aforementioned pilot pressure lower than the hydraulic pressure in the cylinder line 32, is applied to the back pressure chamber 17 through the pilot line 20. That is, the electromagnetic switch valve 21 serving as a switch portion operates to apply the hydraulic pressure in the cylinder line 32 to the back pressure chamber 17 when the switch valve 11 is held at the neutral or supply positions. The electromagnetic switch valve 21 operates to apply the pilot pressure to the back pressure chamber 17 when the switch valve 11 is maintained at the drainage position.

When the hydraulic pressure in the cylinder line 32 is applied to the back pressure chamber 17, the valve body 14 is urged toward the valve seat 18 in such a manner as to disconnect the cylinder line 32 from the switch valve line 33. In contrast, if the pilot pressure, which is lower than the hydraulic pressure in the cylinder line 32, is applied to the back pressure chamber 17, the valve body 14 is spaced from the valve seat 18 in such a manner as to connect the cylinder line 32 to the switch valve line 33. In this state, the valve body 14 moves in correspondence with the hydraulic pressure in the switch valve line 33, thus adjusting the opening degree of the restrictor defined at the opening 19 as has been described.

Next, the operation of the hydraulic control apparatus 1 will be explained. If the switch valve 11 is held at the neutral position as shown in FIG. 1, the spool 22 is located in such a manner as to disconnect the supply line 36 and the first tank line 37 from the switch valve line 33. Therefore, the hydraulic oil is neither supplied to nor drained from the switch valve line 33. Further, in this state, the electromagnetic switch valve 21 operates to disconnect the back pressure chamber 17 of the adjustment valve 12 from the pilot line 20. The hydraulic pressure in the cylinder line 32 is thus introduced into the back pressure chamber 17 via the pressure introduction line 14*c*. At this stage, the first urging force generated by the hydraulic pressure in the cylinder line 32 and the spring 16 is greater than the second urging force generated by the hydraulic pressure in the switch valve line 33, the valve portion 14*a* of the valve body 14 is caused to contact the valve seat 18. This maintains the cylinder line 32 in a state disconnected from the switch valve line 33. In other words, the adjustment valve 12 blocks the flow of the hydraulic oil in a direction in which the hydraulic oil is drained from the lift cylinder 50. This prevents the lift cylinder 50 from retracting and thus maintains the fork at a predetermined height. Further, the connection passage 34 extending from the cylinder line 32 to the switch valve line 33 is blocked by the check valve 35.

Figure 2:
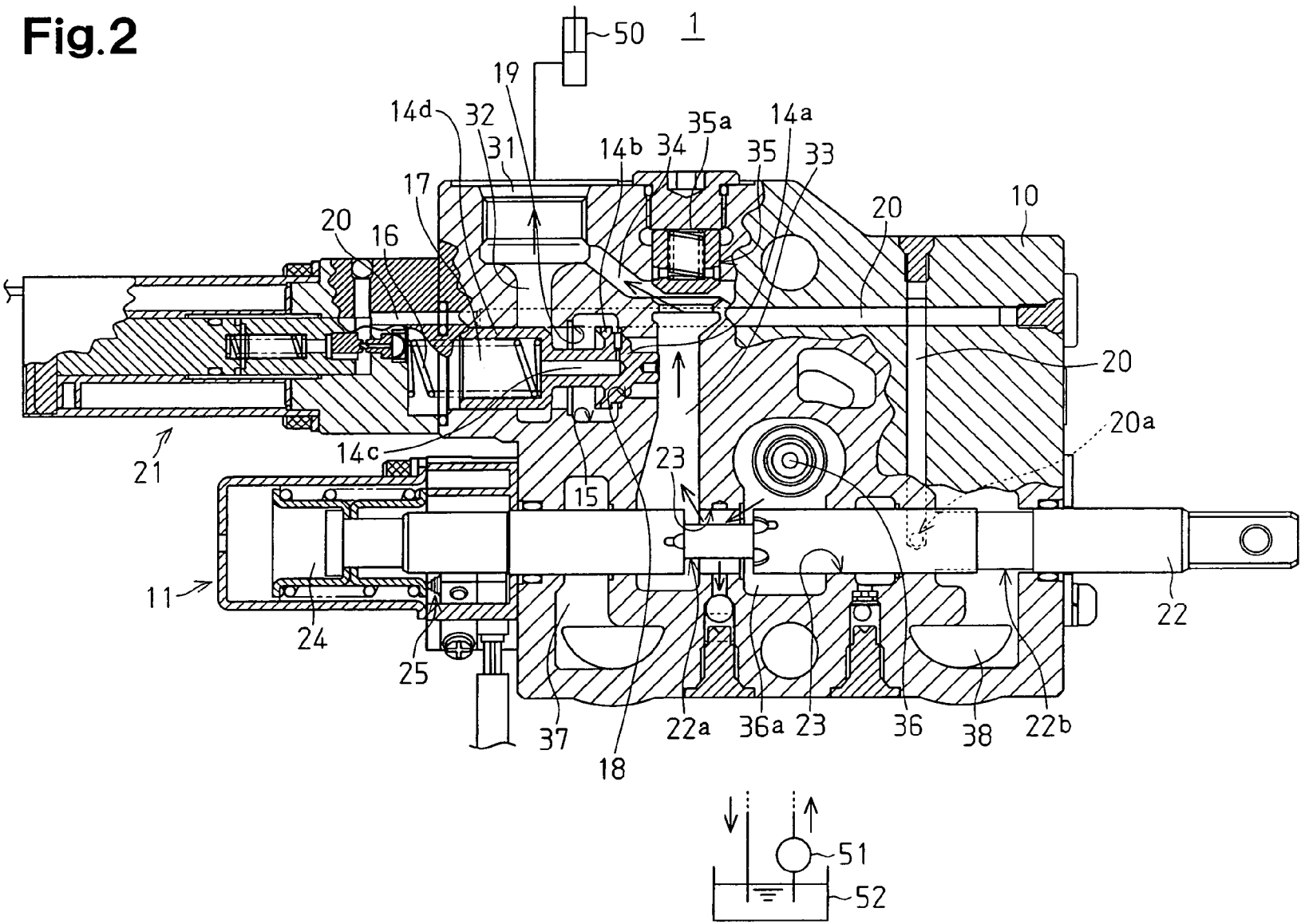
FIG. 2 is a cross-sectional view explaining the operation of the hydraulic control apparatus of FIG. 1.

When the switch valve 11 is switched from the neutral position to the supply position, the hydraulic control apparatus 1 operates in the following manner. FIG. 2 shows the hydraulic control apparatus 1 in which the switch valve 11 is held at the supply position. If the switch valve 11 is switched from the neutral position to the supply position, the spool 22 moves in the direction indicated by arrow A of FIG. 1. Thus, after having been supplied from the pump 51 to the supply line 36, the hydraulic oil is introduced into the switch valve line 33 via a communication passage 36*a* and a passage defined between the first land portion 22*a* of the spool 22 and a corresponding wall of the spool bore 23 as indicated by the corresponding arrows of FIG. 2. In this state, the first tank line 37 is held in a state disconnected from the switch valve line 33. This raises the hydraulic pressure in the switch valve line 33, thus applying a correspondingly increased urging force to the check valve 35. When this urging force exceeds the urging force acting on the check valve 35 generated by the spring 35*a* and the hydraulic pressure in the cylinder line 32, the check valve 35 becomes open. This connects the switch valve line 33 to the cylinder line 32 through the connection passage 34, thus sending the hydraulic oil to the cylinder line 32. The hydraulic oil is then supplied to the lift cylinder 50 and thus raises the fork. In this state, the electromagnetic switch valve 21 maintains the pilot line 20 in a state disconnected from the back pressure chamber 17.

Therefore, the first urging force generated by the hydraulic pressure in the back pressure chamber 17 and the spring 16 is greater than the second urging force generated by the hydraulic pressure in the switch valve line 33. The adjustment valve 12 is thus maintained closed.

When the switch valve 11 is switched from the neutral position of FIG. 1 to the drainage position, the hydraulic control apparatus 1 operates as follows. FIG. 3 shows the hydraulic control apparatus 1 in which the switch valve 11 is held at the drainage position. If the switch valve 11 is switched from the neutral position to the drainage position, the spool 22 moves in the direction indicated by arrow B of FIG. 1. The switch valve line 33 is thus connected to the first tank line 37 through a passage defined between the first land portion 22*a* of the spool 22 and the corresponding wall of the spool bore 23.

Further, if the switch valve 11 is switched to the drainage position, the limit switch 25 generates a detection signal. In response to the detection signal, the controller (not shown) switches the electromagnetic switch valve 21 in such a manner as to connect the pilot line 20 to the back pressure chamber 17. The hydraulic oil is thus sent from the back pressure chamber 17 to the pilot line 20.

Meanwhile, in correspondence with the movement of the spool 22, the second land portion 22*b* reaches a position corresponding to the opening 20*a* of the pilot line 20. As the spool 22 further moves, the portion of the opening 20*a* blocked by the spool 22 becomes gradually smaller and, in contrast, the portion of the opening 20*a* corresponding to the second land portion 22*b* becomes gradually larger. Accordingly, the communication area (the opening degree) of the passage between the pilot line 20 and the second tank line 38 gradually increases, thus increasing the flow rate of the hydraulic oil from the pilot line 20 to the second tank line 38, correspondingly. Once the opening 20*a* entirely corresponds to the second land portion 22*b*, the communication state of the pilot line 20 with respect to the second tank line 38 is maintained without changing.

When the switch valve 11 is switched to the drainage position, the hydraulic oil flows from the back pressure chamber 17 to the second tank line 38 through the pilot line 20 as indicated by the corresponding arrows of FIG. 3. This lowers the pressure in the back pressure chamber 17. In other words, the pilot pressure lower than the hydraulic pressure in the cylinder line 32 acts in the back pressure chamber 17. Therefore, the second urging force generated by the hydraulic pressure in the switch valve line 33 becomes greater than the first urging force generated by the hydraulic pressure in the back pressure chamber 17 and the spring 16. This causes the valve body 14 to separate from the valve seat 18, thus opening the adjustment valve 12. The hydraulic oil thus flows from the lift cylinder 50 to the switch valve line 33 via the cylinder line 32 and the fluid chamber 15. The hydraulic fluid is then sent from the first tank line 37 to the tank 52, thus lowering the fork.

Further, if the hydraulic pressure in the switch valve line 33 changes when the switch valve 11 is held at the drainage position and the hydraulic fluid flows out of the lift cylinder 50, or when the fork is being lowered, the equilibrium between the first urging force and the second urging force applied to the valve body 14 is quickly cancelled, causing the valve body 14 to move. This changes the opening degree of the restrictor defined at the opening 19, thus changing the flow rate of the hydraulic oil from the cylinder line 32 to the switch valve line 33 so as to adjust the hydraulic pressure in the switch valve line 33. In this manner, the lowering speed of the fork can be adjusted (pressure compensation function).

As has been described, when the switch valve 11 is held at the neutral position in the hydraulic control apparatus 1 of the illustrated embodiment, the hydraulic pressure in the cylinder line 32 is applied to the back pressure chamber 17 of the adjustment valve 12 for urging the valve body 14 in such a manner as to disconnect the cylinder line 32 from the switch valve line 33. Therefore, with the switch valve 11 held at the neutral position, the adjustment valve 12 is maintained in a state in which the cylinder line 32 is disconnected from the switch valve line 33. This restricts the drainage of the hydraulic oil from the lift cylinder 50 and thus retraction (lowering due to the weight of the lift cylinder 50) of the lift cylinder 50. That is, as long as the switch valve 11 is maintained at the neutral position, the adjustment valve 12 functions as an operation check valve.

If the switch valve 11 is switched from the neutral position to the drainage position, the pilot pressure lower than the hydraulic pressure in the cylinder line 32 is applied to the back pressure chamber 17 of the adjustment valve 12. This reduces the urging force applied from the back pressure chamber 17 to the valve body 14, thus switching the adjustment valve 12 from a closed state to an open state. The hydraulic oil is thus drained from the lift cylinder 50 to the tank 52. With the switch valve 11 held at the drainage position, the valve body 14 of the adjustment valve 12 is permitted to move in the fluid chamber 15 in correspondence with change of the hydraulic pressure in the switch valve line 33. In correspondence with the movement of the valve body 14, the opening degree of the restrictor provided between the cylinder line 32 and the switch valve line 33 changes. Accordingly, the adjustment valve 12 functions also as a flow regulator for adjusting the flow rate of the fluid drained from the lift cylinder 50.

The adjustment valve 12 is formed by a single component functioning as both the operation check valve and the flow regulator. This makes it unnecessary to provide an operation check valve and an flow regulator separately from each other, thus reducing the quantity of the components, simplifying the configuration of the hydraulic control apparatus 1, and saving the space for installing each of the components in the hydraulic control apparatus 1. In this manner, a simply configured core type hydraulic control apparatus 1 is obtained.

If the hydraulic pressure in the switch valve line 33 rises when the switch valve 11 is held at the drainage position and the hydraulic fluid is drained from the lift cylinder 50, the opening degree of the restrictor of the adjustment valve 12 decreases and the hydraulic pressure in the switch valve line 33 drops. The flow rate of the hydraulic oil drained from the lift cylinder 50 is thus adjusted in a predetermined range. That is, the lowering speed of the fork is adjusted correspondingly (the pressure compensation function).

Since the valve seat 18 with which the valve body 14 is held in contact is formed by the corresponding wall section of the fluid chamber 15, the configuration of the adjustment valve 12 becomes further simple. Also, the restrictor is defined at a position corresponding to one of the opposing openings of the fluid chamber 15, or the opening 19, while the valve seat 18 is formed at a position corresponding to the other opening. In other words, since the restrictor and the valve seat 18 are both provided in the fluid chamber 15, the configuration of the adjustment valve 12 is further simplified. Further, immediately after the valve body 14 starts to separate from the valve seat 18, or at an initial stage of opening of the adjustment valve 12 (when the adjustment valve 12 is open only slightly), the restrictor opposed to the valve seat 18 with respect to the valve body 14 is held in a sufficiently open state. Therefore, even if the hydraulic pressure in the cylinder line 32 is relatively low, the hydraulic oil is quickly sent from the cylinder line 32. That is, even if the hydraulic pressure in the cylinder line 32 is extremely low (for example, if the cylinder line 32 is completely or nearly completely free from load) immediately after switching of the switch valve 11 to the drainage position, the fork is lowered at a relatively high speed.

The pressure introduction line 14*c* is defined in the valve body 14. Therefore, when the switch valve 11 is held at the neutral or supply positions, the hydraulic pressure is supplied from the cylinder line 32 to the back pressure chamber 17 by means of a relatively simple structure.

The valve control device 13 is formed by the pilot line (the pilot pressure generating portion) 20 and the electromagnetic switch valve (the switch portion) 21, which cooperates with each other. By operating the electromagnetic switch valve 21 with the pilot line 20 maintained in a state generating the pilot pressure, the pilot pressure is quickly supplied to the back pressure chamber 17 in response to such operation. This improves the response of the adjustment valve 12.

Further, the pilot pressure generating portion for generating the pilot pressure lower than the hydraulic pressure in the cylinder line 32 is relatively easily provided simply by defining the pilot line 20, which connects the back pressure chamber 17 to the tank 52. This permits the adjustment valve 12 to operate in such a manner that the difference between the hydraulic pressure in the switch valve line 33 upstream from the switch valve 11 and the hydraulic pressure in the second tank line 38 (the tank 52) downstream from the switch valve 11 is maintained in a predetermined range. Accordingly, regardless of the load pressure acting on the fork, the fork lowering speed is adjusted in accordance with the operational amount of the switch valve 11 (the pressure compensation function).

When the switch valve 11 is switched to the drainage position, the portion of the opening 20*a* corresponding to the second land portion 22*b* becomes gradually larger in correspondence with the movement of the spool 22 in the spool bore 23. This gradually changes the communication state of the back pressure chamber 17 with respect to the tank 52. Therefore, at an initial stage of switching of the switch valve 11 to the drainage position, the opening degree of the adjustment valve 12 gradually increases, thus permitting the fork to be finely controlled when being lowered. These advantages are brought about simply by forming the second land portion 22*b* in the spool 22 and connecting the pilot line 20 to the spool bore 23 through the opening 20*a*.

Further, since the hydraulic oil leaking from the electromagnetic switch valve 21, which is arranged between the back pressure chamber 17 and the pilot line 20, is extremely small, leakage of the hydraulic oil from the electromagnetic switch valve 21 to the tank 52 is suppressed. Therefore, when the switch valve 11 is held at the neutral position, the retraction of the lift cylinder 50 is suppressed, thus preventing the fork from lowering due to the weight of the fork.

When the switch valve 11 is switched to the supply position, the hydraulic oil is supplied from the switch valve line 33 to the cylinder line 32 through the connection passage 34, which is different from a path including the adjustment valve 12. This simplifies the configuration of the connection passage 34, thus decreasing the pressure loss caused through the supply of the hydraulic oil to the lift cylinder 50.

The present invention is not limited to the illustrated embodiment but may be modified in the following forms.

The illustrated embodiment has been described for the hydraulic control apparatus 1 for actuating the lift cylinder 50 of the forklift. However, the present invention may be applied to hydraulic control apparatuses for actuating different types of single-acting cylinders other than the lift cylinder 50.

The shapes of the valve body 14 and the fluid chamber 15 of the adjustment valve 12 do not necessarily have to be those of the illustrated embodiment but may be modified as needed.

The pilot pressure generating portion does not necessarily have to be formed by the pilot line 20 that introduces the pressure in the tank 52 into the back pressure chamber 17. The pilot pressure generating portion may be configured in any other suitable manner as long as the pilot pressure lower than the hydraulic pressure in the cylinder line 32 is generated and applied to the back pressure chamber 17. Also, the switch portion does not necessarily have to be formed by the electromagnetic switch valve 21.

The switch valve 11 is not limited to a manually operated type but may be formed by an electromagnetic proportional control valve. In this case, the hydraulic control apparatus 1 is formed as an electromagnetic hydraulic control system.

Figure 4:
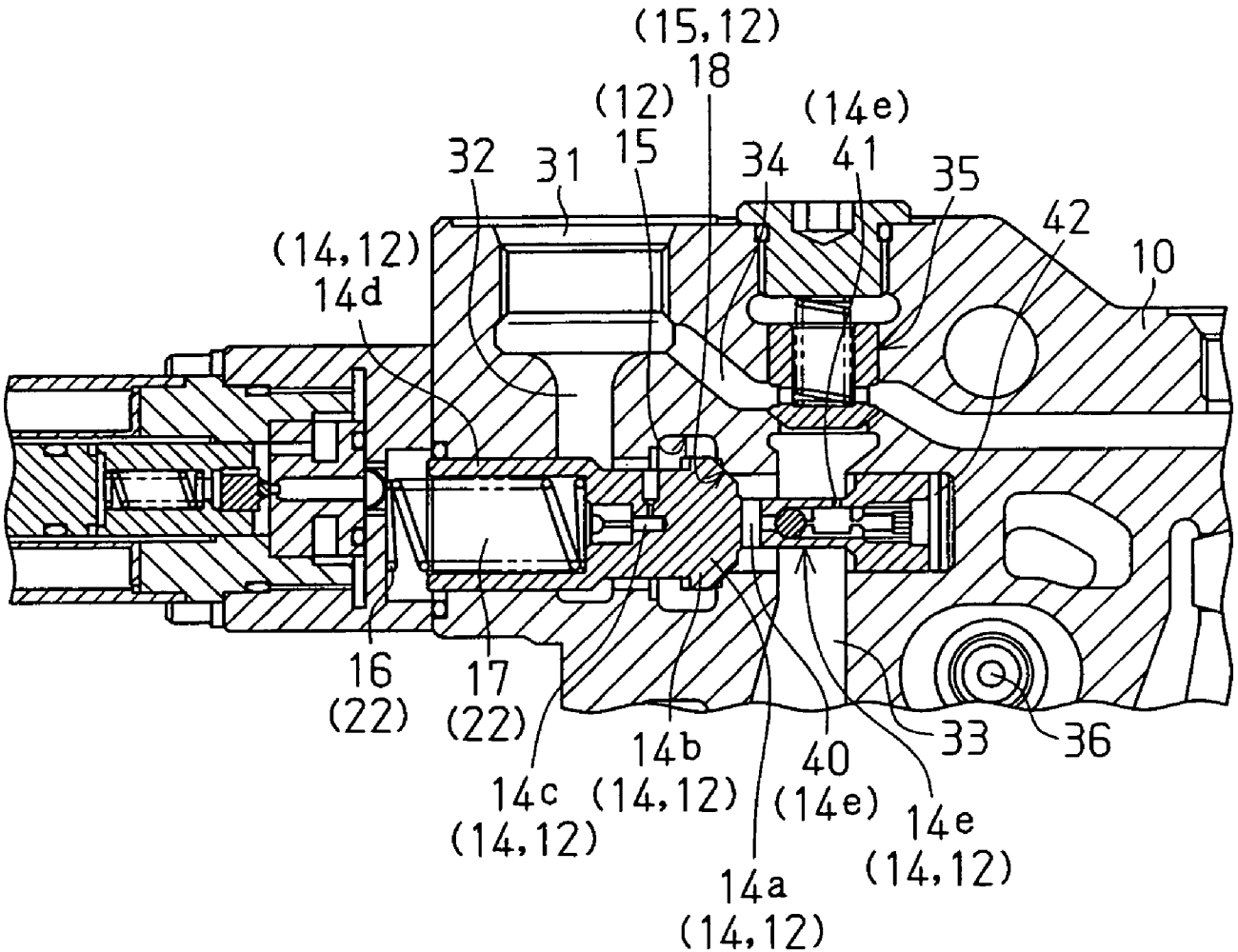
FIG. 4 is a cross-sectional view showing a portion of a hydraulic control apparatus of a modification.

As shown in FIG. 4, a damper 14*e* may be formed at a distal end of the valve body 14 of the adjustment valve 12. The damper 14*e* extends from the distal end of the valve portion 14*a* of the valve body 14 and is formed integrally with the valve body 14. The damper 14*e* is received in an oil chamber 42 defined in the valve housing 10 in an axially movable manner. A recess defined in the damper 14*e* may be connected to the switch valve line 33 through an oil passage 40 defined in the valve body 14. Further, the recess communicates with the switch valve line 33 through an orifice 41 formed in the damper 14*e*. A check valve mechanism is provided in the damper 14*e*.

If the switch valve 11 is switched to the drainage position and the valve body 14 of the adjustment valve 12 is caused to move axially, the hydraulic oil flows into the switch valve line 33 via the orifice 41, which restricts such flow, after having been introduced into the recess in the damper 14*e* through the oil passage 40. In this manner, the damper 14*e* damps hydraulic pulsation that may be generated through movement of the valve body 14.

Accordingly, when the fork carries an object and is lowered in this state, vibration is prevented from being caused in the object due to the hydraulic pulsation.

The invention claimed is:

1. A hydraulic control apparatus for a single-acting cylinder, comprising:

a switch valve for controlling supply and drainage of a fluid with respect to the cylinder, the switch valve being switched among a supply position for supplying the fluid to the cylinder, a drainage position for draining the fluid from the cylinder, and a neutral position for preventing the supply and the drainage of the fluid with respect to the cylinder;

a cylinder line connected to the single-acting cylinder;

a switch valve line connected to the switch valve;

an adjustment valve arranged between the cylinder line and the switch valve line for selectively connecting and disconnecting the cylinder line and the switch valve line with respect to each other; and a valve control device for controlling operation of the adjustment valve, wherein the adjustment valve includes a fluid chamber, a valve body movably received in the fluid chamber, and a back pressure chamber into which a fluid pressure acting on the valve body is introduced, a restrictor being formed between the valve body and a wall defining the fluid chamber for connecting the cylinder line to the switch valve line, an opening degree of the restrictor being changed in correspondence with movement of the valve body, and wherein, when the switch valve is located at the neutral position or the supply position, the valve control device applies a fluid pressure in the cylinder line to the back pressure chamber for urging the valve body in a direction for disconnecting the cylinder line from the switch valve line, and when the switch valve is located at the drainage position, the valve control device applies a pilot pressure lower than the fluid pressure in the cylinder line to the back pressure chamber, wherein the wall defining the fluid chamber forms a valve seat with which the valve body is brought into contact, the cylinder line being disconnected from the switch valve line when the valve body contacts the valve seat, wherein the fluid chamber includes a first opening communicating with the cylinder line and a second opening communicating with the switch valve line, the restrictor being defined at a position corresponding to the first opening, the valve seat being formed at a position corresponding to the second opening.

2. The apparatus according to claim 1, wherein the apparatus is connected to a pump and a tank, wherein, when the switch valve is switched to the supply position, the fluid sent from the pump is permitted to flow into the switch valve line, when the switch valve is switched to the drainage position, the fluid is permitted to flow from the switch valve line to the tank, and when the switch valve is switched to the neutral position, the switch valve line is disconnected from the pump and the tank.

3. The apparatus according to claim 1, wherein the valve body moves in correspondence with a fluid pressure in the switch valve line in such a manner that the opening degree of the restrictor becomes smaller as the fluid pressure in the switch valve line becomes greater.

4. The apparatus according to claim 1, wherein an urging member is provided in the back pressure chamber, the urging member urging the valve body in the direction for disconnecting the cylinder line from the switch valve line.

5. The apparatus according to claim 1, wherein a pressure introduction line is defined in the valve body for connecting the cylinder line to the back pressure chamber.

6. A hydraulic control apparatus for a single-acting cylinder, comprising:

a switch valve for controlling supply and drainage of a fluid with respect to the cylinder, the switch valve being switched among a supply position for supplying the fluid to the cylinder, a drainage position for draining the fluid from the cylinder, and a neutral position for preventing the supply and the drainage of the fluid with respect to the cylinder;

a cylinder line connected to the single-acting cylinder;

a switch valve line connected to the switch valve;

an adjustment valve arranged between the cylinder line and the switch valve line for selectively connecting and disconnecting the cylinder line and the switch valve line with respect to each other; and a valve control device for controlling operation of the adjustment valve, wherein the adjustment valve includes a fluid chamber, a valve body movably received in the fluid chamber, and a back pressure chamber into which a fluid pressure acting on the valve body is introduced, a restrictor being formed between the valve body and a wall defining the fluid chamber for connecting the cylinder line to the switch valve line, an opening degree of the restrictor being changed in correspondence with movement of the valve body, and wherein, when the switch valve is located at the neutral position or the supply position, the valve control device applies a fluid pressure in the cylinder line to the back pressure chamber for urging the valve body in a direction for disconnecting the cylinder line from the switch valve line, and when the switch valve is located at the drainage position, the valve control device applies a pilot pressure lower than the fluid pressure in the cylinder line to the back pressure chamber, wherein the valve control device includes:

a pilot pressure generating portion for generating the pilot pressure; and a switch portion switched in such a manner that the fluid pressure in the cylinder line is permitted to be applied to the back pressure chamber when the switch valve is located at the neutral position or the supply position, and that the pilot pressure is permitted to be applied to the back pressure chamber when the switch valve is located at the drainage position, wherein, when the switch valve is switched to the drainage position, the fluid is permitted to flow from the switch valve line into a tank connected to the apparatus, and wherein the pilot pressure generating portion includes a pilot line that is connectable to the tank, wherein, when the switch valve is switched to the drainage position, the switch portion connects the pilot line to the back pressure chamber.

7. The apparatus according to 6, wherein the switch valve connects the pilot line to the tank when switched to the drainage position.

8. The apparatus according to claim 7, wherein the switch valve is formed by a spool valve having a spool bore and a spool movably received in the spool bore, and wherein the pilot line includes an opening communicating with the spool bore, the pilot line being permitted to communicate with the tank with a gradually increasing communication area in correspondence with movement of the spool when the switch valve is being switched to the drainage position.

9. The apparatus according to claim 8, wherein the spool has a land portion for permitting the opening of the pilot line to communicate with the tank, a size of a portion of the opening corresponding to the land portion being gradually changed in correspondence with the movement of the spool.

10. The apparatus according to claim 6, wherein the switch portion is formed by an electromagnetic switch valve that is switched for selectively connecting and disconnecting the back pressure chamber and the pilot line with respect to each other.

11. A hydraulic control apparatus for a single-acting cylinder, comprising:

a switch valve for controlling supply and drainage of a fluid with respect to the cylinder, the switch valve being switched among a supply position for supplying the fluid to the cylinder, a drainage position for draining the fluid from the cylinder, and a neutral position for preventing the supply and the drainage of the fluid with respect to the cylinder;

a cylinder line connected to the single-acting cylinder;

a switch valve line connected to the switch valve;

an adjustment valve arranged between the cylinder line and the switch valve line for selectively connecting and disconnecting the cylinder line and the switch valve line with respect to each other;

a valve control device for controlling operation of the adjustment valve; and a connection passage extending between the cylinder line and the switch valve line without passing through the adjustment valve, wherein, when the switch valve is switched to the supply position, the fluid is permitted to flow from the switch valve line to the cylinder line through the connection passage;

wherein the adjustment valve includes a fluid chamber, a valve body movably received in the fluid chamber, and a back pressure chamber into which a fluid pressure acting on the valve body is introduced, a restrictor being formed between the valve body and a wall defining the fluid chamber for connecting the cylinder line to the switch valve line, an opening degree of the restrictor being changed in correspondence with movement of the valve body, and wherein, when the switch valve is located at the neutral position or the supply position, the valve control device applies a fluid pressure in the cylinder line to the back pressure chamber for urging the valve body in a direction for disconnecting the cylinder line from the switch valve line, and when the switch valve is located at the drainage position, the valve control device applies a pilot pressure lower than the fluid pressure in the cylinder line to the back pressure chamber.

* * * * *